US008641362B1

(12) United States Patent
Liang

(10) Patent No.: US 8,641,362 B1
(45) Date of Patent: Feb. 4, 2014

(54) TURBINE EXHAUST CYLINDER AND STRUT COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 395 days.

(21) Appl. No.: 13/244,967

(22) Filed: Sep. 26, 2011

Related U.S. Application Data

(60) Provisional application No. 61/533,821, filed on Sep. 13, 2011.

(51) Int. Cl.
*F01D 17/00* (2006.01)

(52) U.S. Cl.
USPC ..... 415/1; 415/115; 415/116; 415/180

(58) Field of Classification Search
USPC ..... 415/1, 115, 116, 117, 178, 180, 144
See application file for complete search history.

(56) References Cited

U.S. PATENT DOCUMENTS

| | | | | |
|---|---|---|---|---|
| 2,648,492 | A * | 8/1953 | Stalker | 415/181 |
| 2,789,416 | A * | 4/1957 | Mirza | 60/266 |
| 3,372,874 | A * | 3/1968 | Colville et al. | 239/127.3 |
| 3,970,252 | A * | 7/1976 | Smale et al. | 239/127.3 |
| 4,214,441 | A * | 7/1980 | Mouritsen et al. | 60/262 |
| 4,355,507 | A * | 10/1982 | Coffey et al. | 60/39.5 |
| 6,266,954 | B1 * | 7/2001 | McCallum et al. | 60/806 |
| 7,805,925 | B2 * | 10/2010 | Durocher et al. | 60/264 |
| 2012/0321451 | A1 * | 12/2012 | Xiao et al. | 415/180 |

* cited by examiner

*Primary Examiner* — Edward Look
*Assistant Examiner* — William Grigos
(74) *Attorney, Agent, or Firm* — John Ryznic

(57) ABSTRACT

A turbine exhaust cylinder for an industrial gas turbine engine with an external blower that delivers cooling air to an inner space of the exhaust cylinder that provides cooling for the struts that support the exhaust cylinder. The cooling air passes over the bearing housing and then up through a space formed between a fairing and the strut. The cooling air is then discharged through a cover plate.

5 Claims, 4 Drawing Sheets

TURBINE EXHAUST CYLINDER AND STRUT COOLING

CROSS-REFERENCE TO RELATED APPLICATIONS

This application claims the benefit to U.S. Provisional Application 61/533,821 filed on Sep. 13, 2011 and entitled TURBINE EXHAUST CYLINDER AND STRUT COOLING.

GOVERNMENT LICENSE RIGHTS

None.

BACKGROUND OF THE INVENTION

1. Field of the Invention

The present invention relates generally to an industrial gas turbine engine, and more specifically to a turbine exhaust cylinder cooling of an industrial gas turbine engine.

2. Description of the Related Art Including Information Disclosed Under 37 CFR 1.97 and 1.98

In a gas turbine engine, such as a large frame heavy duty industrial gas turbine engine used to produce electric power, a hot gas stream is passed through a multiple stage turbine to drive a compressor and an electric generator. The turbine exhaust is channeled through a turbine exhaust casing to safely discharge the hot exhaust gas out from the engine and surrounding environment. The turbine exhaust gas is still rather hot and can erode parts of the engine downstream from the turbine. The turbine exhaust casing is supported by a number of struts that pass through fairings that have an airfoil shape. FIG. 1 shows a prior art engine with a turbine exhaust casing in which a strut 14 passing through a fairing 18. The last stage turbine rotor blade 11 rotates along with a rotor disk 12. An engine casing 13 supports the struts 14 and fairings 18. A cover plate 15 enclosed the space. A tie rod 16 connects the casing 13 to an outer diameter cylinder 27. An inner diameter cylinder 19 is located inward of the OD cylinder 27 and together forms a flow path for the turbine exhaust. A man-way 20 is formed between an exhaust cylinder 21 and an enclosure 22. The engine center line is labeled C.L. in FIG. 1. In this embodiment, no cooling is provided for the fairing 18 and struts 14

FIG. 2 shows a front view of the turbine exhaust casing support with the casing 13 supporting six struts 14 that each pass through a separate fairing 18. The inner ends of the struts 14 are secured to a bearing housing 24. The turbine exhaust gas flow path is formed between the inner diameter cylinder 19 and the outer diameter cylinder 27 and flows around the fairing 18.

FIG. 3 shows an embodiment in which the struts 14 and the fairings 18 are cooled by passing ambient air through the fairings 18. Ambient cooling air is drawn into the exhaust casing through the cover plate 15 and then flows through the space formed between the struts 14 and the fairings 18. There are six cover plates 15 open with one cover plate 15 for each of the struts 14 and fairings 18. During engine operation, the flow path pressure ID of the blade exhaust cylinder junction is lower than the ambient pressure. Cooling air is sucked in due to this pressure differential. At a 100% loading condition, the maximum delta pressure is around 1.0 psi. Such low pressure differential is not enough to induce a large amount of ambient cooling air into the exhaust cylinder to provide adequate cooling for the struts and casing. At some operational point, the delta pressure is even lower than 1.0 psi. As a result of inadequate available cooling, high temperature resistant materials are used for the struts and the casing in the design and therefore significantly increase the design cost.

BRIEF SUMMARY OF THE INVENTION

An industrial gas turbine engine with a turbine exhaust casing and struts that is cooled by pressurized cooling air supplied from an external blower that forces the pressurized cooling air through a passage that opens into the inner diameter cylinder and then passes through the fairings that surround the struts to provide cooling for these areas of the exhaust casing. The cooling air passes through the struts and fairings and then is discharged through the cover plates formed at each struts.

In one embodiment, the blower passes the compressed air through a man-way and into the inner enclosure that then flows into the space formed by the inner diameter cylinder. The cooling air discharged from the struts and fairings also flows over the outer diameter cylinder to provide cooling for this part of the engine.

DETAILED DESCRIPTION OF THE INVENTION

The present invention is a turbine exhaust casing cooling system for a large frame heavy duty industrial gas turbine engine, but could be used for other gas turbine engines. The turbine exhaust gas is passed through an exhaust casing formed by an outer diameter (OD) cylinder rand an inner diameter (ID) cylinder in which struts extend between. The struts are surrounded by airfoil shaped fairings. Without adequate cooling, the cylinders and the struts and the fairings must be formed from high temperature resistant materials to reduce or eliminate thermal damage such as erosion that shorten the useful life of these parts.

Figure 1:
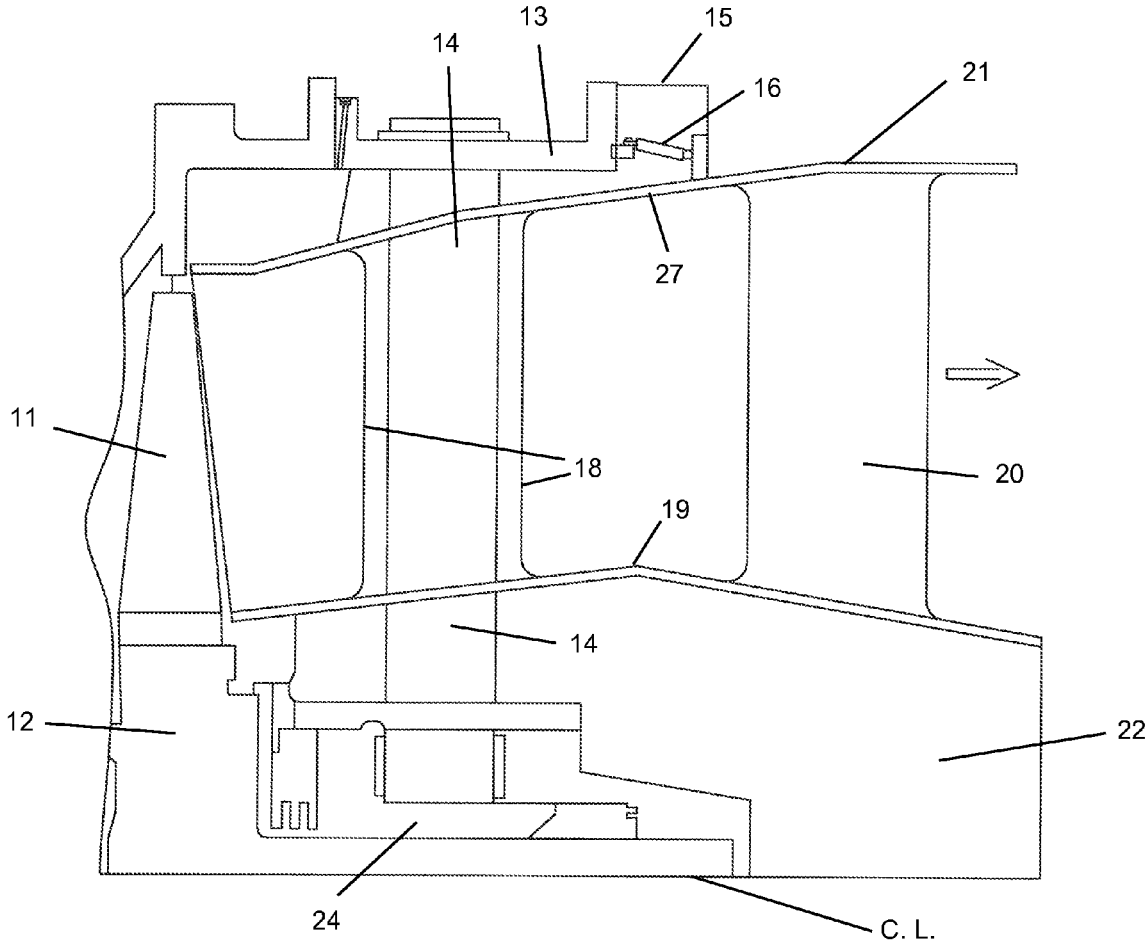
FIG 1 Prior Art
FIG. 1 shows a cross section side view of a turbine exhaust casing without cooling of the prior art.
Figure 2:
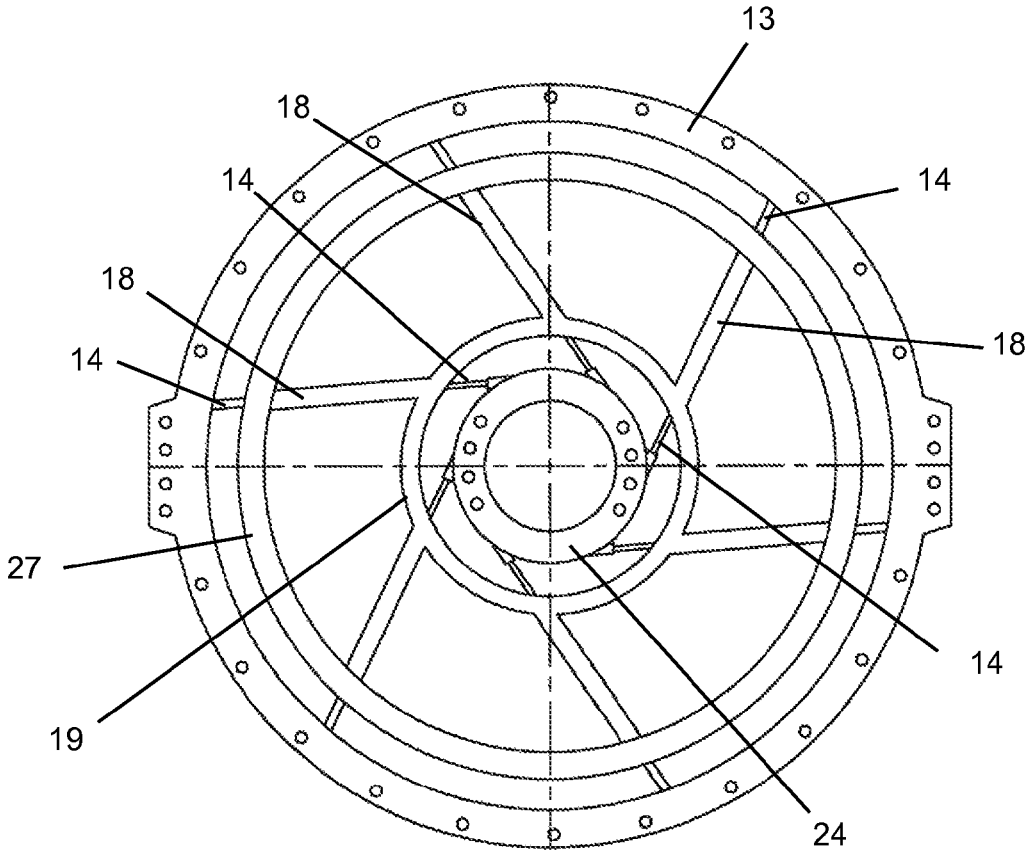
FIG 2 Prior Art
FIG. 2 shows a cross section front view of the turbine exhaust casing of FIG. 1 passing through the struts and fairings.
Figure 3:
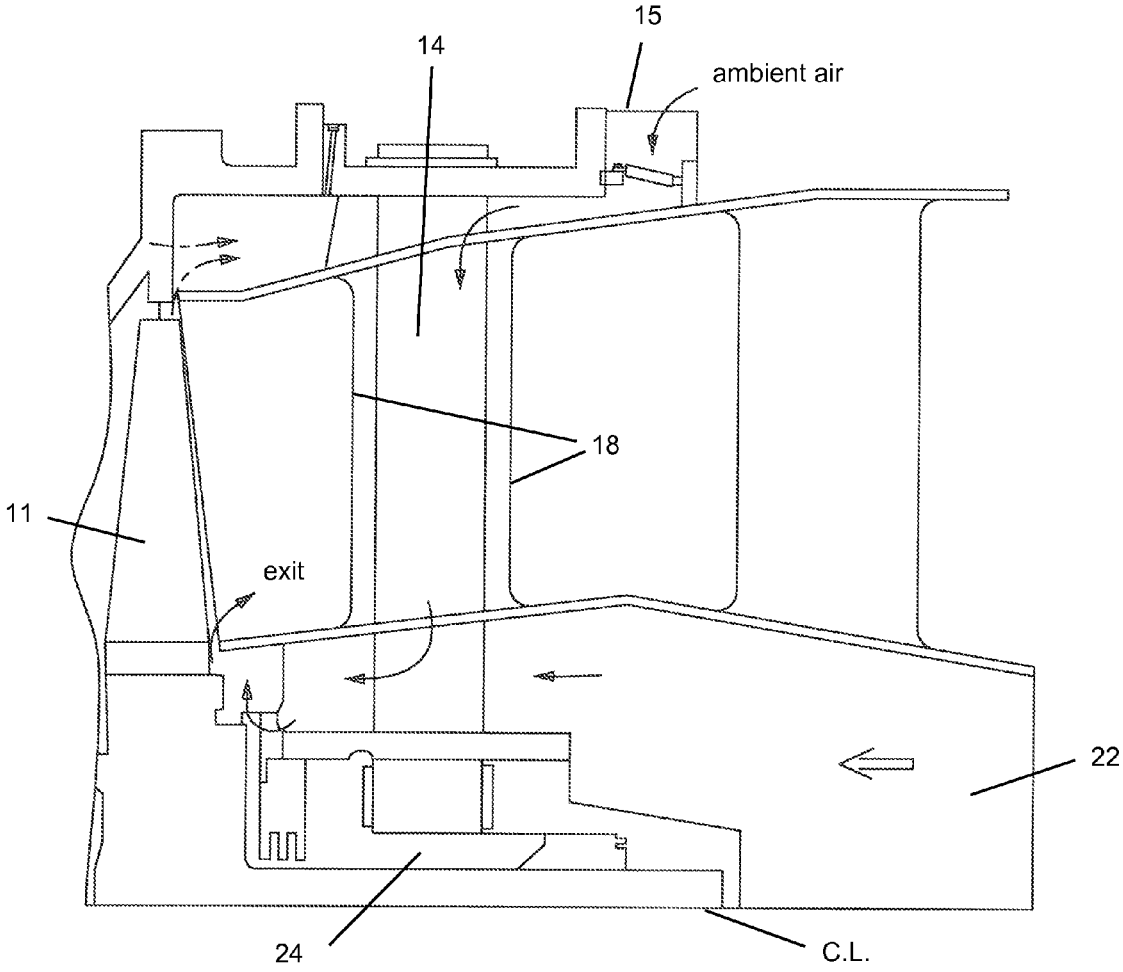
FIG 3 Prior Art
FIG. 3 shows a cross section side view of a turbine exhaust casing with passive cooling of the struts and fairings and OD and ID cylinders using ambient air.
Figure 4:
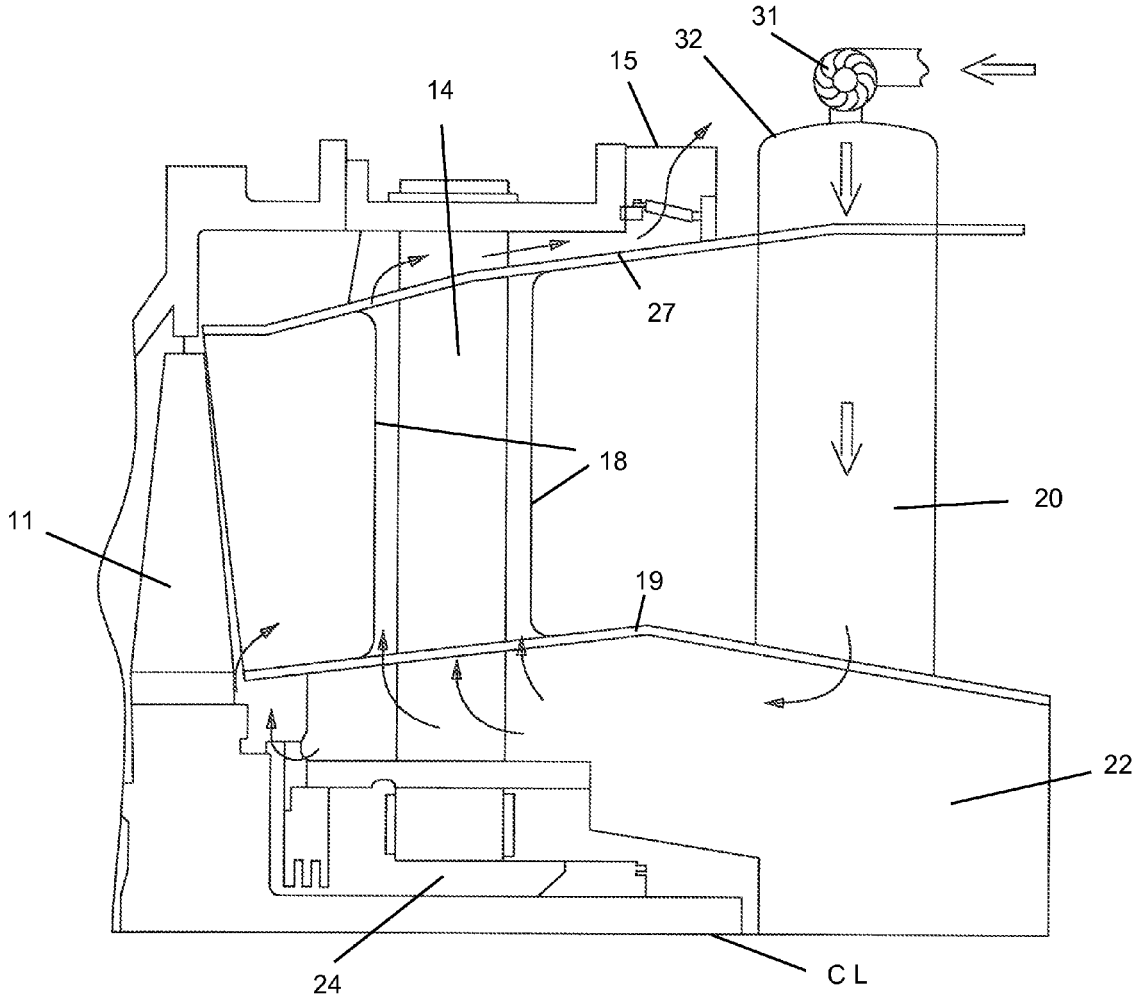
FIG. 4 shows a cross section side view of a turbine exhaust casing with pressurized cooling for the struts and fairings and the OD and ID cylinders of the present invention.

FIG. 4 shows a cross section side view of the present invention that includes a last stage turbine rotor blade 11 with an OD cylinder 27 and an ID cylinder 19 forming a flow path for the hot exhaust gas from the turbine. An external blower 31 is secured to a man-way extension 32 so that ambient air can be drawn into the blower 31 and pressurized to a sufficient level or pressure to provide enough cooling air flow to adequately cool the cylinders 19 and 27 and the struts 14 and fairings 18. The cooling air from the blower 31 flows into the man-way 20 and then into the inner enclosure 22, where the cooling air then flows within the ID cylinder to provide cooling to this surface including the bearing housing 24. The cooling air then flows up within the space formed between the struts 14 and the fairings 18 to provide cooling for both parts. The cooling air then flows out from the fairings 18 and into the space formed above the OD cylinder 27 to provide cooling to this surface. The cooling air then flows out through the cover plates 15. There is one cover plate 15 for each strut 14 and fairing 18 arrangements. However, this could be changed without exceeding the spirit and scope of the present invention.

The blower produces a forced convection cooling for the struts and minimizes a thermal mismatch for the casing using a large amount of relatively low pressure cooling air. This design will minimize a thermal growth for the struts and mismatch for the casing during engine operation and shut down. Also, the design lowers the struts and casing metal temperature to yield a better match between the lower half and the upper half casing temperature. A lower strut strain range and casing blowing is achieved which eliminates the strut creep issues and provides for a higher overall exhaust cylinder operating life. Also, a cooler strut metal temperature and a more uniform casing temperature also provides better control of bearing bore movement and thus improves blade tip clearance and the engine performance.

In operation, the ambient cooling air is supplied through the blower mounted on top of the man-way 20. A portion of the cooling air is channeled through the forward cavity and into the hot gas stream in-between the turbine and exhaust cylinder interface. A majority of the cooling air is channeled through the fairings for cooling of the struts first. The turbine exhaust fairings are mounted in the hot flow path at a slender angle. Cooling air will exit from the turbine fairings and impinge onto the backside surface of the casing first. This provides backside impingement cooling of the casing. Because the fairings are at a relative angle to the casing, the spent cooling air is swirled around the inner wall of the casing prior to exiting through the open cover plate.

I claim the following:

1. An industrial gas turbine engine exhaust cylinder comprising:

an inlet end connected to receive a turbine exhaust gas flow and an outlet end;

an outer diameter cylinder and an inner diameter cylinder forming a flow path through the exhaust cylinder for the turbine exhaust gas;

a fairing having an airfoil shape extending from the outer diameter cylinder to the inner diameter cylinder;

a strut extending from an outer casing to an inner casing and passing through the fairing with a space formed between the fairing and the strut for cooling air to flow;

a manway located downstream from the fairing and extending through the outer diameter cylinder to the inner diameter cylinder and opening into an enclosure formed within the inner diameter cylinder;

a blower secured to the manway outside of the outer diameter cylinder; and, the blower pushing cooling air through the manway and into the enclosure and then through the space formed between the fairing and the strut to provide cooling for the inner casing and the strut.

2. The industrial gas turbine engine exhaust cylinder of claim 1, and further comprising:

the inner casing is a bearing casing.

3. The industrial gas turbine engine exhaust cylinder of claim 1, and further comprising:

an opening on the outer casing and connected to the outer diameter cylinder to discharge the cooling air that cools the strut.

4. A process for cooling for cooling a turbine exhaust cylinder for an industrial gas turbine engine, the turbine exhaust cylinder includes an outer diameter cylinder and an inner diameter cylinder that forms a flow path for a turbine exhaust gas, the turbine exhaust cylinder including a plurality of fairing each with a strut to support the turbine exhaust cylinder, the process comprising the steps of:

passing ambient cooling air from outside the outer diameter cylinder to a space formed within the inner diameter cylinder to provide cooling for the inner diameter cylinder;

passing the cooling air from the space formed within the inner diameter cylinder through a space formed between the fairings and the struts;

passing the cooling air from the space formed between the fairings and the struts over the outer diameter cylinder to provide cooling for the outer diameter cylinder; and, discharging the cooling air from the turbine exhaust cylinder.

5. The process for cooling for cooling a turbine exhaust cylinder of claim 4, and further comprising the step of:

the step of passing the cooling air within the space formed within the inner diameter cylinder includes passing the cooling air over a bearing housing to provide cooling for the bearing housing.

* * * * *